US009400142B2

(12) United States Patent
Holm et al.

(10) Patent No.: US 9,400,142 B2
(45) Date of Patent: Jul. 26, 2016

(54) HEAT EXCHANGER

(75) Inventors: Martin Holm, Lund (SE); Rolf Ekelund, Klippan (SE); Jenny Rasmussen, Malmö (SE); Fredrik Blomgren, Malmö (SE)

(73) Assignee: ALFA LAVAL CORPORATE AB, Lund (SE)

( * ) Notice: Subject to any disclaimer, the term of this patent is extended or adjusted under 35 U.S.C. 154(b) by 823 days.

(21) Appl. No.: 13/127,741

(22) PCT Filed: Oct. 22, 2009

(86) PCT No.: PCT/SE2009/051205

§ 371 (c)(1),
(2), (4) Date: Jul. 5, 2011

(87) PCT Pub. No.: WO2010/056183

PCT Pub. Date: May 20, 2010

(65) Prior Publication Data

US 2011/0247790 A1 Oct. 13, 2011

(30) Foreign Application Priority Data

Nov. 12, 2008 (SE) ..... 0802382

(51) Int. Cl.
*F28F 3/08* (2006.01)
*F28F 13/06* (2006.01)
(Continued)

(52) U.S. Cl.
CPC ..... *F28D 9/005* (2013.01); *F28F 3/046* (2013.01); *F28F 3/083* (2013.01); *F28F 2215/04* (2013.01); *F28F 2250/06* (2013.01)

(58) Field of Classification Search
CPC ..... F28F 3/048; F28F 3/08; F28F 3/083; F28D 9/005
USPC ..... 165/166, 167
See application file for complete search history.

(56) References Cited

U.S. PATENT DOCUMENTS 4,434,643 A 3/1984 Almqvist et al.
4,586,562 A 5/1986 Carlson et al.
(Continued)

FOREIGN PATENT DOCUMENTS

CN 101069058 A 11/2007
JP 63-25494 2/1988
(Continued)

OTHER PUBLICATIONS

Form PCT/ISA/237 for Application No. PCT/SE2009/051205, dated Mar. 21, 2011.
(Continued)

*Primary Examiner* — Judy Swann
*Assistant Examiner* — John Higgins
(74) *Attorney, Agent, or Firm* — Buchanan Ingersoll & Rooney PC

(57) ABSTRACT

A heat exchanger plate, where the plate is provided with a heat transfer surface having a corrugated pattern, comprising a diagonal open and closed side distribution support section positioned between a diagonal open respectively closed groove and the heat transfer surface, and a diagonal open and closed side adiabatic support section positioned between the open respectively closed diagonal groove and a port hole, where the heat exchanger plate further comprises a transfer path between the diagonal open side distribution support section and the heat transfer surface and a bypass path between the diagonal closed side distribution support section and the heat transfer surface. A heat exchanger comprising a plurality of heat exchanger plates is also disclosed. The advantage of this heat exchanger plate is that it allows for heat exchangers with an improved efficiency.

8 Claims, 3 Drawing Sheets

(51) Int. Cl.

| | |
|---|---|
| ***F28D 9/00*** | (2006.01) |
| ***F28F 3/04*** | (2006.01) |

(56) References Cited

U.S. PATENT DOCUMENTS

| | | | | |
|---|---|---|---|---|
| 4,781,248 | A | 11/1988 | Pfeiffer | |
| 4,911,235 | A | 3/1990 | Andersson et al. | |
| 5,222,551 | A * | 6/1993 | Hasegawa et al. | 165/167 |
| 5,443,115 | A | 8/1995 | Pedersen et al. | |
| 5,858,177 | A | 1/1999 | Morris | |
| 6,199,626 | B1 | 3/2001 | Wu et al. | |
| 6,241,672 | B1 | 6/2001 | Hochman et al. | |
| 6,394,178 | B1 | 5/2002 | Yoshida et al. | |
| 7,040,387 | B2 | 5/2006 | Leuthner et al. | |
| 2001/0030043 | A1 | 10/2001 | Gleisle et al. | |
| 2005/0178536 | A1 * | 8/2005 | Blomgren et al. | 165/167 |
| 2006/0249282 | A1 | 11/2006 | Song | |
| 2007/0089871 | A1 | 4/2007 | Andersson et al. | |
| 2008/0029257 | A1 * | 2/2008 | Nilsson | 165/167 |
| 2008/0196873 | A1 | 8/2008 | Svensson | |

FOREIGN PATENT DOCUMENTS

| | | | |
|---|---|---|---|
| JP | 06-241672 | A | 9/1994 |
| JP | 6241672 | A | 9/1994 |
| JP | 09-152127 | A | 6/1997 |
| JP | 10339590 | A | 12/1998 |
| JP | 11-51581 | | 2/1999 |
| JP | 11-248392 | | 9/1999 |
| JP | 2004-504584 | A | 2/2004 |
| RU | 2110030 | C1 | 4/1998 |
| RU | 2293271 | C2 | 2/2007 |
| WO | 2007/073304 | A1 | 6/2007 |
| WO | 2007/073305 | | 6/2007 |
| WO | 2007/142592 | | 12/2007 |

OTHER PUBLICATIONS

PCT/ISA/210 for for Application No. PCT/SE2009/051205, dated Mar. 21, 2011, 5 pages.

Office Action (Rejection Notice) for Japanese Patent Application No. 2011-536284 dated Nov. 27, 2012 with English translation.

Russian Office Action (Decision on Grant Patent for Invention) dated Aug. 20, 2012, issued by the Patent Office of the Russian Federation in corresponding Russian Patent Application No. 2011123885, and an English Translation of the Office Action. (3 pgs.).

Search Report (State Intellectual Property Office of People's Republic China) dated Oct. 22, 2009, issued in corresponding Chinese Application No. 200980145630.5 (2 pgs.).

Office Action (Rejection Notice) issued on Sep. 10, 2013, by the Japanese Patent Office in corresponding Japanese Patent Application No. 2011-536284, and an English Translation of the Office Action. (3 pages).

* cited by examiner

HEAT EXCHANGER

TECHNICAL FIELD

The present invention relates to a heat exchanger plate that will enable an improved flow distribution when used in a heat exchanger. The invention further relates to a heat exchanger comprising a plurality of heat exchanger plates.

BACKGROUND ART

A conventional type of plate heat exchanger use heat transfer plates fitted with gaskets that seal off each channel from the next, and direct the fluids into alternate channels. This type of plate heat exchanger is used throughout industry as standard equipment for efficient heating, cooling, heat recovery, condensation and evaporation.

Such a plate heat exchanger consists of a series of thin corrugated heat exchanger plates fitted with gaskets. The plates are then compressed together between a frame plate and a pressure plate in order to create an arrangement of parallel flow channels. The two fluids flow in alternate channels which gives a large surface area over which the transfer of heat energy from one fluid to the other can take place. The channels are provided with different corrugated patterns designed to induce maximum turbulence in both the fluid flows in order to make heat transfer as efficient as possible. The two different fluids normally enter and leave at the top and bottom of the heat exchanger, respectively. This is known as the counter-current flow principle.

One advantage with heat exchangers having gaskets compared with brazed heat exchangers is that it is easy to separate the heat exchanger plates. This is of advantage e.g. when they need to be cleaned or when the capacity of the heat exchanger is to be adjusted. This is done by simply adding or removing heat exchanger plates when required.

In one type of plate heat exchangers, the heat exchanger comprises one type of plate, which is mounted with every other plate rotated 180 degrees to form two different channels for the fluids, one channel for the cooling medium and one channel for the product that is to be cooled. A sealing is provided between each plate. Such an arrangement is cost-effective and works for many applications. Each plate is provided with ridges and valleys in order to on one hand provide a mechanical stiffness and on the other hand to improve the heat transfer to the liquid. The plates will bear on each other where the patterns of the plates meet each other, which will improve the mechanical stiffness of the plate package. This is important especially when the fluids have different pressures. For this type of heat exchanger, the inlet and outlet opening regions must be adapted so that they work for both channels.

In a heat exchanger channel, it is of advantage that the temperature distribution over the channel width is as even as possible. An uneven temperature distribution will influence the efficiency of the heat exchanger in a negative way. This is e.g. the case for a fluid that is to be heated. With an uneven temperature distribution, part of the fluid will be heated more than enough while part of the fluid is heated less than enough. At the outlet port, the fluid is mixed which means that part of the heated fluid will be cooled by the other part of the fluid.

The problem with an uneven temperature distribution is present in most heat exchangers. This is due to the fact that the inlet and outlet ports are arranged in a non-symmetric way with regards to the heat transfer surface of the heat exchanger. In a conventional heat exchanger, the inlet and outlet ports are arranged at the corners of the heat exchanger plates. In this way, the heat transfer surface is held as large as possible. The disadvantage of this arrangement is that the distance that the fluid must travel differs over the plate width.

Different approaches to solve this problem are known. It is common to improve the flow distribution by using different types of patterns in the flow channel. In larger heat exchangers, a specific pattern is used in the distribution area of the heat exchanger, and another pattern is used in the heat transfer area of the heat exchanger. The purpose of the different patterns is to increase the pressure drop over the heat transfer channel in order to distribute the fluid more even. It is however not possible to increase the pressure drop too much. For smaller heat exchangers, it is not possible to have a specific distribution area due to the size of the heat exchanger plates. In heat exchangers comprising different heat exchanger plates, it is possible to have different distribution patterns for the different flow channels. This is not the case for heat exchangers comprising only one type of heat exchanger plates.

In application JP 09152127, a heat exchanger having heat exchanger plates with flat areas is shown. Each heat exchanger plate is provided with three areas with a chevron shaped pattern and there between two flat areas with no pattern at all. The purpose of this design is to allow the water flow to mix in the flat areas, thereby equalising the temperature distribution in the heat exchanger. This solution may work for larger heat exchangers, where size is not an issue, but seems to be rather space consuming. The flat surfaces will reduce the effective heat transfer surface, which makes the heat exchanger rather large. The pattern is also asymmetric lengthwise which requires a two-plate design of the heat exchanger.

These solutions may function for some applications, but they still show some disadvantages. There is thus room for improvements.

DISCLOSURE OF INVENTION

An object of the invention is therefore to provide a heat exchanger plate allowing for a heat exchanger having an improved flow distribution. A further object of the invention is to provide a heat exchanger having an improved flow distribution.

The solution to the problem according to the invention is described in the characterizing part of claim 1. Claims 2 to 6 contain advantageous embodiments of the heat exchanger plate. Claim 7 contain an advantageous heat exchanger and claims 8 to 12 contain advantageous embodiments of the heat exchanger.

With a heat exchanger plate, where the plate is provided with a heat transfer surface having a corrugated pattern with a plurality of ridges and valleys, and where the heat exchanger plate comprises an open adiabatic distribution area positioned between a port hole and the heat transfer surface, and a closed adiabatic area positioned between a port hole and the heat transfer surface, where the open adiabatic distribution area comprises a diagonal open side distribution support section positioned between a diagonal open groove and the heat transfer surface, and a diagonal open side adiabatic support section positioned between the open diagonal groove and the port hole, where the closed adiabatic area comprises a diagonal closed side distribution support section positioned between a diagonal closed groove and the heat transfer surface, and a diagonal closed side adiabatic support section positioned between the closed diagonal groove and the port hole, the object of the invention is achieved in that the heat exchanger plate further comprises a transfer path between the diagonal open side distribution support section and the heat transfer surface and a bypass path between the diagonal closed side distribution support section and the heat transfer surface.

By this first embodiment of the heat exchanger plate, a heat exchanger plate is obtained which allows for an improved flow distribution inside a heat exchanger. In this way, the efficiency of a heat exchanger can be improved. In particular, the invention allows a uniform flow distribution over the entire width of the heat transfer passage in a plate heat exchanger. This is achieved in that a bypass passage in created in the flow channels of the heat exchanger, which allows the fluid to enter the heat transfer passage over the complete width of the heat exchanger. Areas in which no fluid can flow or in which the flow speed is low is thus avoided.

In an advantageous development of the inventive heat exchanger plate, the bypass path is wider than the transfer path. The advantage of this is that the openings from the bypass passage into the heat transfer passage are created, having a relatively low pressure drop. This will allow the fluid to flow from the bypass passage into the heat transfer passage in a uniform way.

In an advantageous development of the inventive heat exchanger plate, the transfer path and the bypass path have a height of half the pressing depth of the corrugated pattern. The advantage of this is that the openings from the bypass passage into the heat transfer passage can be optimised, thereby improving the flow distribution in the heat exchanger further.

In an inventive heat exchanger, the heat exchanger comprises a transfer passage between an adiabatic passage and the heat transfer passage, and a bypass passage between a channel sealing gasket and the heat transfer surface. This allows for an improved heat exchanger with an improved efficiency.

By this first embodiment of the heat exchanger, a heat exchanger which allows for an improved flow distribution is obtained. This is achieved in that the bypass passage allows fluid to enter the heat transfer passage over the complete width of the heat exchanger. Areas in which no fluid can flow or in which the flow speed is low is thus avoided.

In an advantageous further development of the inventive heat exchanger, an end region of the heat transfer surface of one heat exchanger plate extends over the bypass path of another heat exchanger plate. This is advantageous in that relatively large openings in the bypass passage are created, which allows the fluid flowing in the bypass passage to enter into the heat transfer passage with a low pressure drop. The improved flow properties avoid flow regions having a low flow speed in the heat transfer passage. The entire heat transfer passage of the heat exchanger can thus be used for the heat transfer between the two flow channels of the heat exchanger.

BRIEF DESCRIPTION OF DRAWINGS

The invention will be described in greater detail in the following, with reference to the embodiments that are shown in the attached drawings, in which.

MODES FOR CARRYING OUT THE INVENTION

The embodiments of the invention with further developments described in the following are to be regarded only as examples and are in no way to limit the scope of the protection provided by the patent claims.

Figure 1:
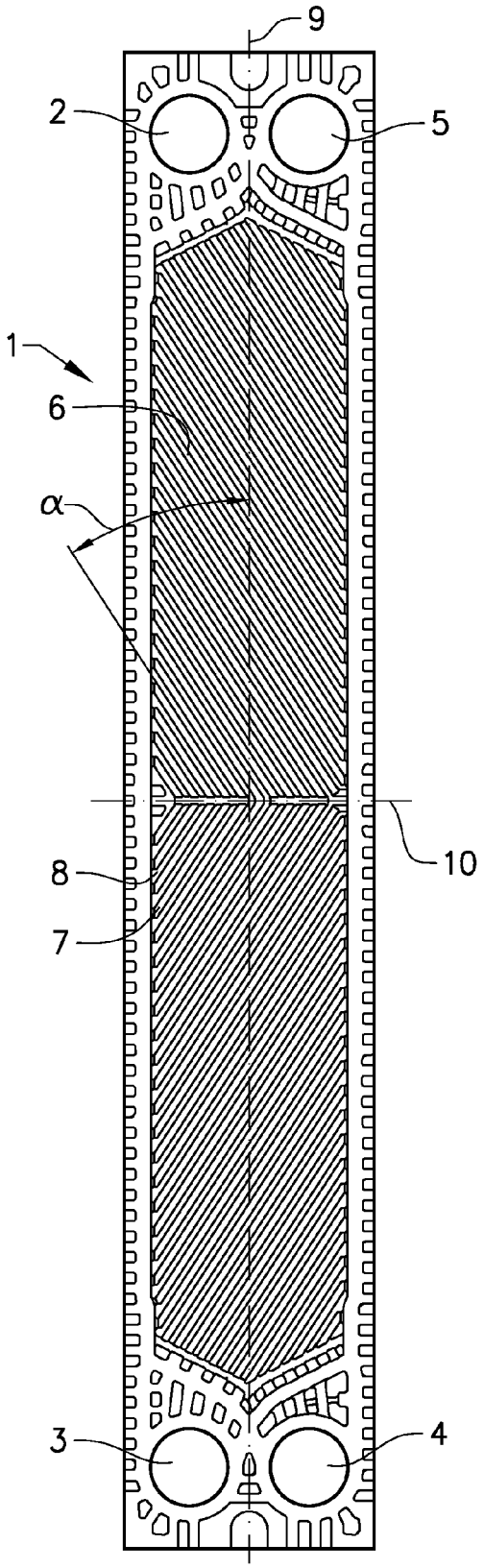
FIG. 1 shows a first embodiment of a heat exchanger plate according to the invention.
Figure 2:
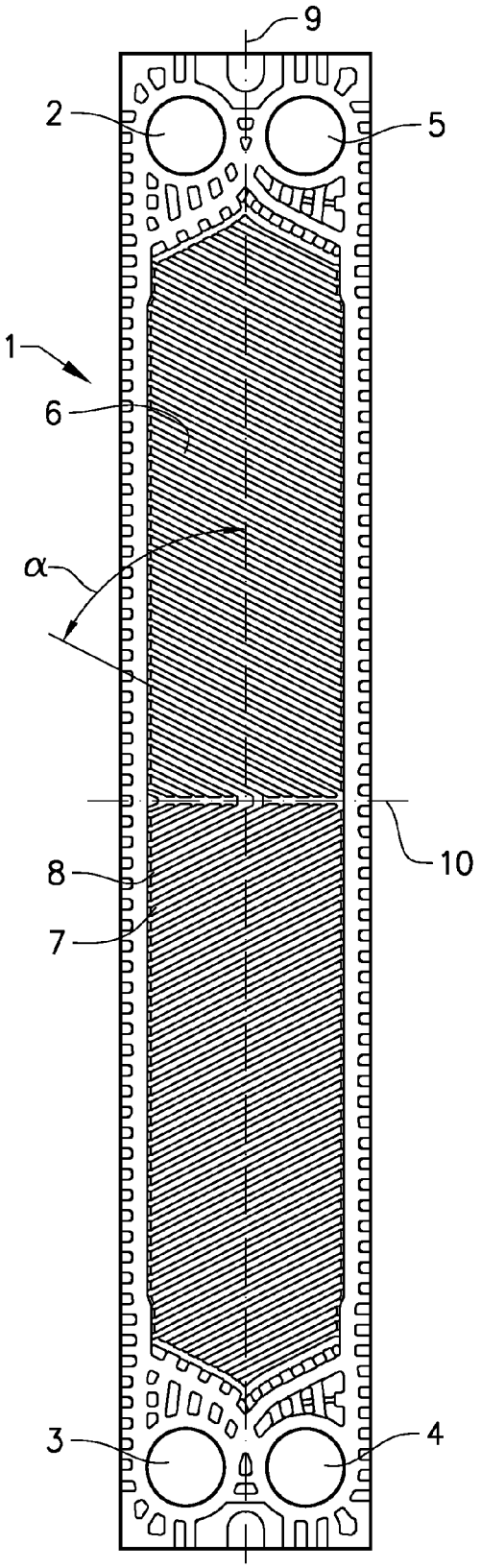
FIG. 2 shows a second embodiment of a heat exchanger plate according to the invention.
Figure 3:
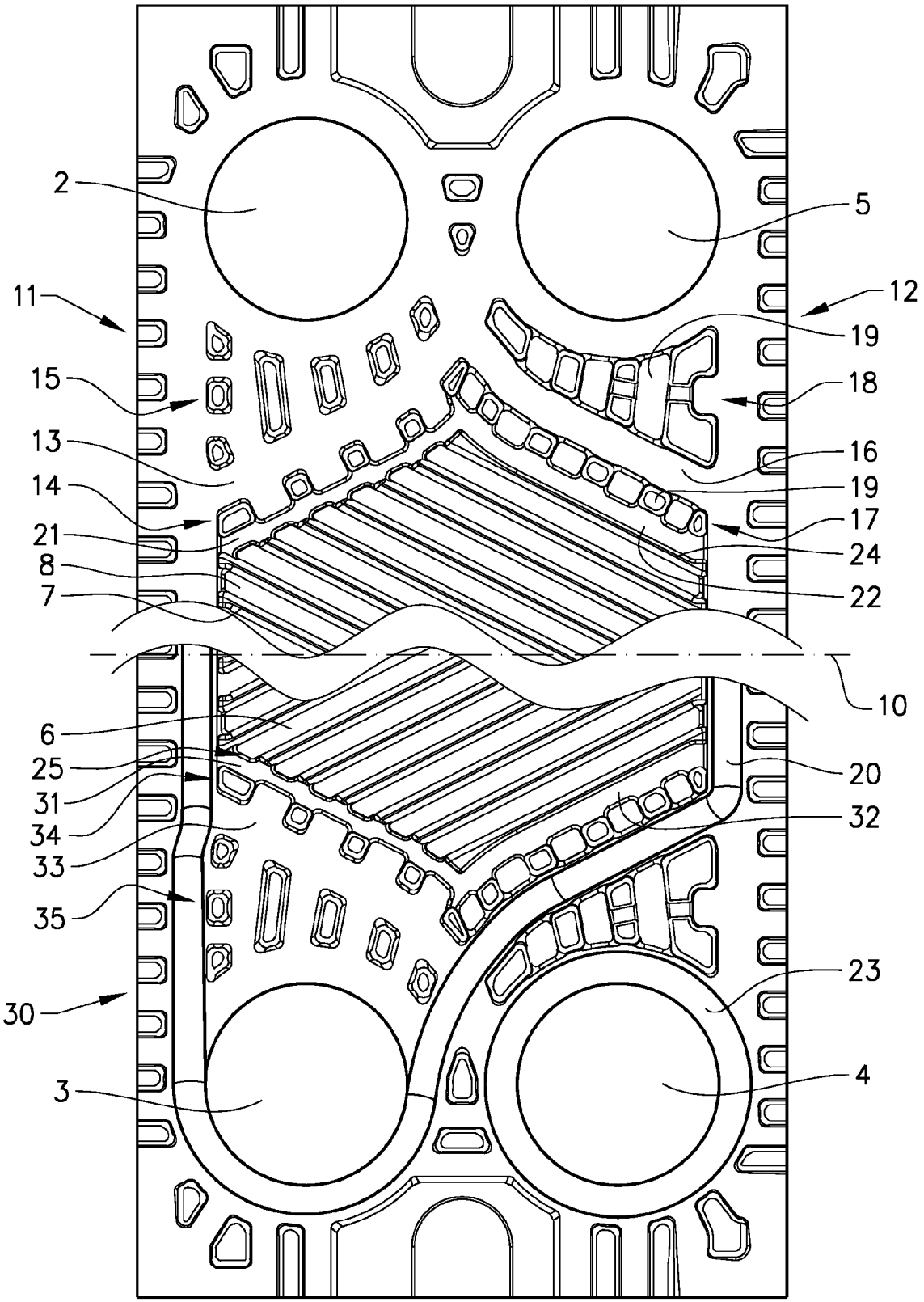
FIG. 3 shows a detail of the heat exchanger plate according to FIG. 2.

In the following, the inventive heat exchanger plate and the inventive heat exchanger will be described. In FIGS. 1 to 3, heat exchanger plates are shown and in FIG. 4, part of a heat exchanger is shown.

FIG. 1 shows a first embodiment of a heat exchanger plate according to the invention. The heat exchanger plate is intended to be used in heat exchangers for general heating and cooling duties of different liquids throughout industry. The heat exchanger plate 1 comprises four port holes 2, 3, 4, 5 that will constitute either inlet ports or outlet ports in the heat exchanger. The shown heat exchanger plate is designed in such a way that one plate type is enough to assemble a heat exchanger. Thus, every other heat exchanger plate is turned upside down with respect to the horizontal axis 10 in order to obtain the different flow channels when the heat exchanger is assembled. In this way, the pattern will interact such that the pattern of one plate will bear on the pattern of the other plate, creating a plurality of intermediate contact points.

The heat exchanger plate further comprises a corrugated heat transfer surface 6 having a corrugated pattern comprising ridges 7 and valleys 8. The corrugated pattern may have different designs. One common pattern design is a so called chevron or fish-bone pattern, in which the corrugations display one or more direction changes. A simple form of the chevron shaped pattern is a V-shape. In the shown examples, the corrugated pattern comprises straight longitudinal corrugations. The pattern of the corrugated surface, i.e. the ridges 7 and valleys 8, are angled with respect to the longitudinal axis 9 of the heat exchanger plate. In this example, the corrugated pattern changes the direction at the horizontal axis 10 of the heat exchanger plate, so that the pattern is mirror-inverted with respect to the horizontal axis 10. Depending on the used pattern, the pattern may or may not be mirror-inverted with respect to axis 10. The areas of the plate outside of the heat transfer surface, i.e. the inlet and outlet port regions, is in the shown examples always mirror-inverted.

The angle $\alpha$ with which the corrugated pattern is inclined with respect to the longitudinal axis 9 may be chosen depending on the use for which the heat exchanger is intended. Angels in the range between 20 and 70 degrees are preferred. A larger angle $\alpha$ will give a higher pressure drop for the flow channels, while a smaller angle $\alpha$ will give a lower pressure drop for the flow channels. For the heat exchanger plate shown in FIG. 1, the angle $\alpha$ is 30 degrees. For the heat exchanger plate shown in FIG. 2, the angle $\alpha$ is 60 degrees.

Close to each port hole, between the port hole and the heat transfer surface, is an adiabatic transfer area located. A transfer area comprises a diagonal groove, a diagonal adiabatic support section and a diagonal distribution support section. The transfer area between the port hole 2 and the heat transfer surface is in this example referred to as the open side area, since fluid will flow over this area through the active flow channel. The transfer area between the port hole 5 and the heat transfer surface is in this example referred to as the closed side area, since this area will be delimited by the sealing gasket of the active flow channel.

The upper open side adiabatic transfer area 11 is thus located between port hole 2 and the heat transfer surface 6 and the upper closed side adiabatic area 12 is located between port hole 5 and the heat transfer surface 6. The upper open side adiabatic area 11 comprises a diagonal open side groove 13, a diagonal open side distribution support section 14 and a diagonal open side adiabatic support section 15. The upper closed side adiabatic area 12 comprises a diagonal closed side groove 16, a diagonal closed side distribution support section 17 and a diagonal closed side adiabatic support section 18. The support sections comprise protruding support knobs.

The diagonal grooves are adapted to receive a sealing gasket which is used to define and delimit a flow channel. A diagonal groove may comprise or may not comprise a sealing gasket, depending on the flow channel created between the heat exchanger plates. In FIG. 3, the upper end and the lower end of the heat exchanger plate are shown. Upper end and lower end are only relative terms and refers to one position in which the heat exchanger plate can be used. They are used in this description to distinguish between the two ends.

Figure 4:
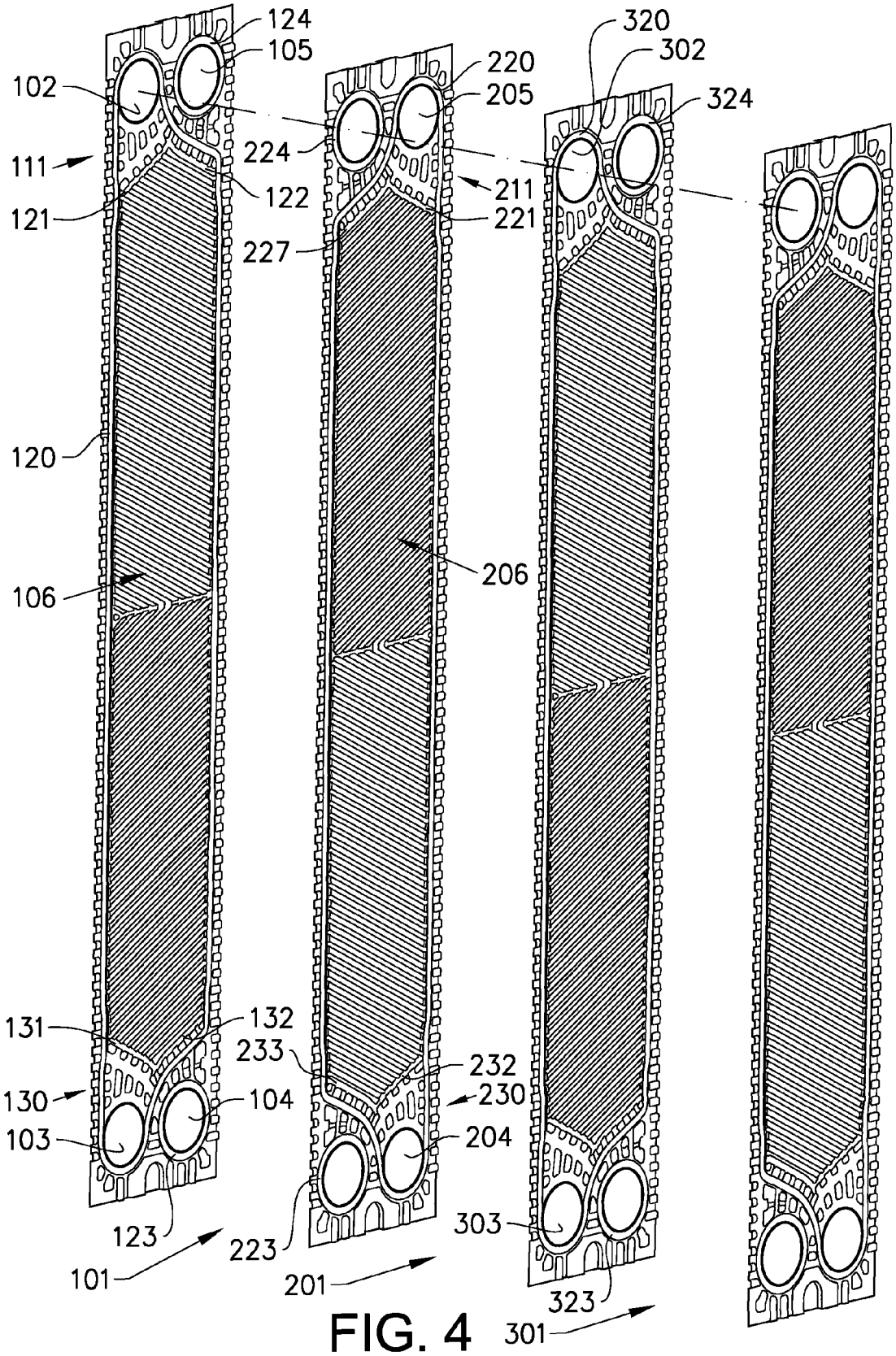
FIG. 4 shows part of a heat exchanger according to the invention.

In FIG. 3, a channel sealing gasket 20 is positioned in the gasket groove around the heat transfer surface such that a first flow channel will be obtained when a second heat exchanger plate is assembled to the first heat exchanger plate. In FIG. 4, both first and second flow channels are shown. The gasket groove is supported by support sections pressed in the heat exchanger plate. The support knobs of one section will bear on the areas between the support knobs of another section when the heat exchanger plates are assembled in the heat exchanger. A port sealing gasket 23 delimits the passive port hole 4.

In the upper open side adiabatic area 11, the diagonal distribution support section 14 is located between the heat transfer surface 6 and the diagonal groove 13, and the diagonal adiabatic support section 15 is located between the diagonal groove 13 and the port hole 2. The diagonal adiabatic support section 15 is essential to stabilize both the upper adiabatic area 11 and the diagonal groove 13. The diagonal distribution support section 14 is essential to stabilize the diagonal groove 13. The support knobs may have different shapes, e.g. square, rectangular or round, but are designed to allow the fluid in the flow channel to flow from the port to the heat transfer passage with a minimum of flow restriction, i.e. the pressure drop through the adiabatic transfer passage should be as low as possible, while at the same time providing a sufficient support to the diagonal groove.

A similar, lower open side adiabatic transfer area 30 is located in the lower part of the heat exchanger plate, between the port hole 3 and the heat transfer surface. The lower adiabatic transfer area comprises a lower transfer path 31, a diagonal open side distribution support section 34, a diagonal groove 33 and a diagonal open side adiabatic support section 35.

In the upper closed side adiabatic transfer area 12, the diagonal distribution support section 17 is located between the heat transfer surface and the diagonal groove 16, and the diagonal adiabatic support section 18 is located between the diagonal groove 16 and the port hole 5. The diagonal adiabatic support section 18 is essential to stabilize both the adiabatic transfer area 12 and the diagonal groove 16. The diagonal distribution support section 17 is essential to stabilize the diagonal groove. The support knobs may have different shapes but are designed to allow the fluid in the flow channel to flow from the port to the heat transfer passage with a minimum of flow restriction, i.e. the pressure drop through the adiabatic transfer passage should be as low as possible. A similar, lower closed side adiabatic transfer area is located in the lower part of the heat exchanger plate, between the port hole 4 and the heat transfer surface.

The pressing depth of the pattern of the heat exchanger plate may vary between different sections of the plate. In the shown example, the upper open side adiabatic transfer area 11 including the diagonal groove 13 is pressed to the full pressing depth. The adiabatic transfer area will thus comprise a first base height level with protruding support knobs of the diagonal distribution support section 14 and the diagonal adiabatic support section 15 having a height of the full pressing depth.

The upper closed side adiabatic transfer area 12 including the diagonal groove 16 is likewise pressed to the full pressing depth. The support knobs have a height of the full pressing depth. In the shown example, the areas between the support knobs of the adiabatic transfer area 12 are provided with edges pressed to the half height in order to increase the stiffness of the support sections 17, 18. Some support knobs are likewise provided with a half-height stiffening embossment. These half-height pressings can be used to stiffen the upper closed side adiabatic transfer area since this side of the adiabatic transfer area will not be part of a flow channel. The edges will thus not interfere with the fluid flow in either of the flow channels.

The support knobs may have different shapes. Their main purpose is to stabilize the adiabatic transfer areas and the diagonal grooves of the heat exchanger. By using support knobs that are separated from the corrugated pattern of the heat transfer surface, a uniform and improved stiffness of the diagonal grooves is obtained. The adiabatic transfer areas will constitute an adiabatic surface when the heat exchanger plate is mounted in a heat exchanger, since the adiabatic transfer areas will not be part of the heat transfer between the two fluid flows in this area.

Between the diagonal open side distribution support section 14 of the upper adiabatic transfer area 11 and the heat transfer surface 6, there is a longitudinal upper transfer path 21 that will form a transfer passage in the flow channel created by two heat exchanger plates. The upper transfer path 21 acts as a transition section between the pattern of the adiabatic transfer area 11 and the pattern of the heat transfer surface. The transfer path has in this example a height of half the pressing depth. It is also possible to let the transfer path have a height of the full pressing depth. In any case, it is important that the transfer passage created between two heat exchanger plates obtains a height of a full pressing depth.

The front side of one heat exchanger plate and the rear side of another heat exchanger plate is used to form a flow channel, and thus a transfer passage is created between the transfer path 21 and the rear side of another heat exchanger plate. In order to obtain a transfer passage having a height of a full pressing depth, it is important that the two corresponding heat exchanger plate surfaces have appropriate heights.

The upper transfer path will create a transfer passage in a flow channel and will allow the fluid in a flow channel to enter into the cross-corrugated pattern of the heat transfer passage in a uniform manner, while minimising the disturbance from the diagonal distribution support section 14. In this way, the diagonal groove 13 is supported in a uniform way and at the same time, a uniform flow into the heat transfer passage is obtained. In known heat exchangers, where the ridges and valleys of the heat transfer surface extend up to a diagonal gasket groove, the diagonal gasket groove will be less rigid since the support of the diagonal gasket groove will be unsymmetrical. The use of a transfer path will thus improve the flow distribution when gasket support knobs are used.

Since the inlet and outlet port regions of the heat exchanger plate is mirror-inverted with respect to the horizontal axis, a lower transfer path 31 is also provided for at the outlet port opening 3. This lower transfer path will create a lower transfer passage that will allow the fluid from the heat transfer passage to flow into the outlet in a uniform way, since the transfer passage will allow the pressure to even out before entering the lower adiabatic transfer passage.

Between the diagonal closed side distribution support section 17 and the heat transfer surface 6 is further a longitudinal upper bypass path 22 provided. The upper bypass path has in this example a height of half the pressing depth, likewise the upper transfer path. This will allow bypass passages to be created on both sides of the heat exchanger plate, i.e. in both the flow channels, which have a total height of a full pressing depth. As for the transfer path, it is important that the obtained bypass passage has a height of a full pressing depth. The actual height of the bypass path will thus cooperate with the corresponding surface of the other heat exchanger plate surface when the bypass passage is created. The upper bypass path will create an upper bypass passage in a flow channel created by two heat exchanger plates. The upper bypass passage will allow fluid from the inlet to enter the complete cross-corrugated pattern of the heat transfer passage. The fluid will flow into the bypass passage, which exhibits a low pressure drop. From the bypass passage, the fluid will enter into the cross-corrugated pattern of the heat transfer passage. In this way, the complete area of the heat transfer passage of the flow channel will be used for heat transfer.

The use of a bypass passage will thus allow fluid to enter into the heat transfer passage in a uniform way. Since the flow resistance in the heat transfer passage is much higher than in the bypass passage, the flow distribution of the heat exchanger will be improved. This will allow the section of the cross-corrugated pattern closest to the port hole 5, i.e. the inlet section of the heat transfer passage furthest away from the inlet port, to be used in an efficient way.

Since the inlet and outlet port regions of the heat exchanger plate is mirror-inverted with respect to the horizontal axis, a lower bypass path 32 is also obtained at the outlet port opening. This bypass path will create a lower bypass passage that will allow the fluid from the section of the cross-corrugated pattern closest to the port hole 4, i.e. the outlet section of the heat transfer passage furthest away from the outlet port 3, to be used in an efficient way.

The width of a transfer path is preferably in the same order as the width of a ridge in the heat transfer surface. The upper transfer path forms a transition from the diagonal distribution support section 14 to the heat transfer surface. The width of the transfer path is selected such that it will allow the pressure of the fluid to even out throughout the transfer passage before the fluid enters the heat transfer passage. If the width of the transfer path is too narrow, the flow along the length of the transfer passage will be limited. With a sufficiently wide transfer path, the flow differences through the diagonal distribution support section will be evened out.

The width of a transfer path or a bypass path is measured at the position where the distance between the pattern of the diagonal distribution support section and the heat transfer surface is the smallest. The narrowest section of a path will determine the pressure drop in a respective passage.

The width of a bypass path is preferably wider than the width of a transfer path in order to allow the fluid to enter into the heat transfer passage from a bypass passage with a relatively low pressure drop. This is especially important for a heat exchanger plate having a corrugated pattern of the heat transfer surface with an angle in the same order as the angle of the bypass path relative the longitudinal axis. Such an example can be seen in FIGS. 2 and 3. Here, a ridge 24 of the corrugated heat transfer pattern runs parallel with the upper bypass path 22. When two heat exchanger plates are assembled to form a flow channel, an upper bypass passage 122 is created between the upper bypass path 22 and the rear plate side of a lower transfer path 31. The fluid that is to enter the heat transfer passage from the bypass passage must thus enter the heat transfer passage through the openings created between the ridge 24 and the end region 25 of the corrugated pattern. It is thus important that the end region of the corrugated pattern of one heat exchanger plate extends over the bypass path. In the shown example, the bypass path has a height of half the pressing depth. With the ridges of the end region 25 extending into and over the bypass path, sufficiently large openings into the heat transfer passage are obtained. In this way, the openings created between the ridge 24 and the end region 25 will allow the fluid to enter through the openings into the heat transfer passage with a reduced pressure drop. The width of the bypass path is preferably in the order of twice the width of the transfer path, and is dimensioned depending on the use of the heat exchanger and the dimensions of the heat exchanger plate.

The bypass path will help to distribute the fluid flow to the entire heat transfer passage in an efficient way. In known heat exchanger plates, the corrugated pattern will end at a diagonal gasket groove, which means that the cross-corrugated pattern may end directly at the sealing gasket. The area close to the sealing gasket, i.e. which is the furthest away from the inlet port, will thus show a slow flow speed of the fluid and will consequently have a poor heat transfer. By introducing the bypass path and individual gasket support knobs in the diagonal distribution support section, an improved flow distribution is obtained in the flow channel of the heat exchanger. This means that the pressure drop through the heat transfer passage will be substantially equal over the total width of the heat exchanger. Through the bypass passage, there is a relatively low pressure drop, especially compared with the pressure drop through the heat transfer passage.

In the same way, there is a lower bypass path 32 in the region close to the outlet port 3. This bypass path will help to create an outlet bypass passage which will allow the complete heat transfer surface of the plate to be used in an efficient way. In known heat exchangers, the area furthest away from the outlet port will display a slow flow speed which in turn gives this area a poor heat transfer.

In FIG. 4, a part of a heat exchanger comprising four heat exchanger plates is shown. Between the heat exchanger plates, flow channels are created. Each flow channel will carry either a first fluid or a second fluid. In the shown example, flow channels 101 and 301 will carry a first fluid and flow channel 201 will carry a second fluid. In the shown example, the flow channels 101 and 201 are used in a counter-flow arrangement, i.e. the flow through flow channel 101 flows in the opposite direction compared with flow channel 201. A complete heat exchanger will comprise a plurality of heat exchanger plates, a front plate and a rear plate. The front and rear plate (not shown) will stabilize the heat exchanger and will also provide connection means for the connection of the heat exchanger.

Each flow channel is defined by a sealing gasket 120, 220, 320 that delimits the flow channel between the heat exchanger plates. The sealing gaskets are normally produced in one piece with interconnecting members between the sealing gaskets. Sealing gaskets 123, 124, 223, 224, 323, 324 seal the port holes that are not active in the respective flow channel. In flow channel 101, the port 102 is an active inlet port and port 103 is an active outlet port. In flow channel 201, the port 204 is an active inlet port and port 205 is an active outlet port. In flow channel 301, the port 302 is an active inlet port and port 303 is an active outlet port.

The first fluid enters flow channel 101 through inlet port 102. The fluid passes through the upper adiabatic passage 111 and part of the fluid is distributed through the upper transfer passage 121 into the heat transfer passage 106. Part of the fluid will flow through the upper bypass passage 122 into heat transfer passage 106. The use of an upper transfer passage 121 will improve the flow distribution of the fluid passing directly from the upper adiabatic passage into the heat transfer passage. The use of an upper bypass passage will increase the flow distribution over the entire heat transfer passage. After the fluid has passed through the complete heat transfer passage, the fluid exits the flow channel through outlet port 103. Part of the fluid passes through the lower transfer passage 131 and the lower adiabatic passage 130 into the outlet port 103. The other part of the fluid passes through the lower bypass passage 132 and through the lower adiabatic passage 130 into the outlet port 103. The use of a lower bypass passage allows part of the fluid to transit through the bypass passage. This allows for an improved flow distribution over the heat transfer passage width of the heat exchanger, which in turn will improve the heat transfer efficiency of the heat exchanger.

The second fluid enters flow channel 201 through inlet port 204, due to the counter-flow arrangement. The fluid passes through the lower adiabatic passage 230 and part of the fluid is distributed through the lower transfer passage 232 into the heat transfer passage 206. Part of the fluid will flow through the lower bypass passage 233 into heat transfer passage 206. The use of a transfer passage 232 will improve the flow distribution of the fluid passing directly from the adiabatic passage into the heat transfer passage. The use of a bypass passage 233 will increase the flow distribution over the entire heat transfer passage. After the fluid has passed through the complete heat transfer passage, the fluid exits the flow channel through outlet port 205. Part of the fluid passes through the upper transfer passage 221 and the upper adiabatic passage 211 into the outlet port 205. The other part of the fluid passes through the upper bypass passage 227 and the upper adiabatic passage 211 into the outlet port 205. The use of a bypass passage allows part of the fluid to transit through the bypass passage. This allows for a more even flow distribution over the heat transfer passage width of the heat exchanger, which in turn will improve the efficiency of the heat transfer of the heat exchanger.

The flow through flow channel 301 is the same as for flow channel 101. This is the repeated for all flow channels in the heat exchanger. The number of flow channels, i.e. the number of heat exchanger plates, in the heat exchanger is determined by the required heat transfer capacity of the heat exchanger.

The heat exchanger plate according to the invention does not include any specific distribution area, but only a heat transfer surface with a certain pattern. The heat transfer surface stretches to the adiabatic area, which advantages for smaller plate heat exchangers where it not is space or possibility for a specific distribution area.

The invention is not to be regarded as being limited to the embodiments described above, a number of additional variants and modifications being possible within the scope of the subsequent patent claims. In one example, a different pattern of the diagonal distribution support section may be used for the heat exchanger cassettes.

REFERENCE SIGNS

Prior Art

1: Heat exchanger plate
2: Port hole
3: Port hole
4: Port hole
5: Port hole
6: Heat transfer surface
7: Ridge
8: Valley
9: Longitudinal axis
10: Horizontal axis
11: Upper open side adiabatic area
12: Upper closed side adiabatic area
13: Diagonal open side groove
14: Diagonal open side distribution support section
15: Diagonal open side adiabatic support section
16: Diagonal closed side groove
17: Diagonal closed side distribution support section
18: Diagonal closed side adiabatic support section
19: Indentations
20: Channel sealing gasket
21: Upper transfer path
22: Upper bypass path
23: Port sealing gasket
24: Ridge
25: End region
30: Lower open side adiabatic area
31: Lower transfer path
32: Lower bypass path
33: Diagonal open side groove
34: Diagonal open side distribution support section
35: Diagonal open side adiabatic support section
101: Flow channel
102: Port hole
103: Port hole
104: Port hole
105: Port hole
106: Heat transfer passage
111: Upper adiabatic passage
120: Channel sealing gasket
121: Upper transfer passage
122: Upper bypass passage
123: Port sealing gasket
124: Port sealing gasket
130: Lower adiabatic passage
131: Lower transfer passage
132: Lower bypass passage
201: Flow channel
202: Port hole
203: Port hole
204: Port hole
205: Port hole
206: Heat transfer passage
211: Upper adiabatic area
220: Channel sealing gasket
221: Upper transfer passage
222: Upper bypass passage
223: Port sealing gasket
224: Port sealing gasket
230: Lower adiabatic area
231: Lower transfer passage
232: Lower bypass passage
301: Flow channel
302: Port hole
303: Port hole
320: Channel sealing gasket
323: Port sealing gasket
324: Port sealing gasket

The invention claimed is:

1. A heat exchanger plate possessing a lengthwise extent and comprising:

a heat transfer surface having a corrugated pattern with a plurality of ridges and valleys;

an open adiabatic distribution area positioned between a first port hole and the heat transfer surface;

a closed adiabatic area positioned between a second port hole and the heat transfer surface;

wherein the open adiabatic distribution area comprises a diagonal open side distribution support section positioned between a diagonal open groove and the heat transfer surface, and a diagonal open side adiabatic support section positioned between the open diagonal groove and the first port hole;

wherein the closed adiabatic area comprises a diagonal closed side distribution support section positioned between a diagonal closed groove and the heat transfer surface, and a diagonal closed side adiabatic support section positioned between the closed diagonal groove and the second port hole;

the heat exchanger plate further comprising a transfer path between the diagonal open side distribution support section and the heat transfer surface, and a bypass path between the diagonal closed side distribution support section and the heat transfer surface, the transfer and bypass paths delimiting the heat transfer surface;

wherein the bypass path possesses a width greater than a width of the transfer path;

wherein the heat exchanger plate possesses a longitudinal axis along the lengthwise extent of the heat exchanger plate that divides the heat exchanger plate into a first half and a second half, the bypass path being located in the first half of the heat exchanger plate, and the transfer path being located in the second half of the heat exchanger plate;

the bypass path arranged to feed fluid from the open adiabatic distribution area directly to the heat transfer surface within the first half of the heat transfer plate;

the transfer path arranged to feed fluid from the open adiabatic distribution area directly to the heat transfer surface within the second half of the heat transfer plate;

wherein the heat exchanger plate is a first heat exchanger plate configured to be stacked with a second heat exchanger plate possessing a bypass path and a transfer path, the bypass path of the second heat exchanger plate being wider than the transfer path of the second heat exchanger plate; and the bypass path and the transfer path of the first heat exchanger plate being located such that when the first heat exchanger plate is stacked with the second heat exchanger plate, the bypass path of the first heat exchanger plate extends along the transfer path of the second heat exchanger plate, the transfer path of the first heat exchanger plate extends along the bypass path of the second heat exchanger plate, and the greater width of the bypass path of the first heat exchanger plate relative to the transfer path of the second heat exchanger plate creates a bypass passage between the bypass path of the first heat exchanger plate and the transfer path of the second heat exchanger plate so that fluid enters a heat transfer passage between the heat transfer surface of the first heat exchanger plate and the heat transfer surface of the second heat exchanger plate from the bypass passage with a pressure drop that is lower than if the bypass and transfer paths possessed equal widths.

2. The heat exchanger plate according to claim 1, wherein the transfer path is closer to the first port hole than is the bypass path.

3. The heat exchanger plate according to claim 1, wherein the transfer path and the bypass path have a height of half the pressing depth of the corrugated pattern.

4. The heat exchanger plate according to claim 1, wherein the corrugated pattern of the heat transfer surface comprises straight longitudinal corrugations.

5. The heat exchanger plate according to claim 1, wherein the corrugated pattern of the heat transfer surface has an angle of between 20 and 70 degrees in relation to the longitudinal axis of the plate.

6. A heat exchanger, comprising a plurality of heat exchanger plates according to claim 1.

7. A plurality of heat exchanger plates comprising:

a first heat exchanger plate and a second heat exchanger plate, the first and second heat exchanger plates each possessing a lengthwise extent and comprising:

a heat transfer surface having a corrugated pattern with a plurality of ridges and valleys;

an open adiabatic distribution area positioned between a first port hole and the heat transfer surface;

a closed adiabatic area positioned between a second port hole and the heat transfer surface;

wherein the open adiabatic distribution area comprises a diagonal open side distribution support section positioned between a diagonal open groove and the heat transfer surface, and a diagonal open side adiabatic support section positioned between the open diagonal groove and the first port hole;

wherein the closed adiabatic area comprises a diagonal closed side distribution support section positioned between a diagonal closed groove and the heat transfer surface, and a diagonal closed side adiabatic support section positioned between the closed diagonal groove and the second port hole;

a transfer path between the diagonal open side distribution support section and the heat transfer surface, and a bypass path between the diagonal closed side distribution support section and the heat transfer surface, the transfer and bypass paths delimiting the heat transfer surface;

wherein the bypass path possesses a width greater than a width of the transfer path;

wherein each one of the first and second heat exchanger plates possesses a longitudinal axis along the lengthwise extent of the one of the first and second heat exchanger plates that divides the one of the first and second heat exchanger plates into a first half and a second half, the bypass path being located in the first half of the one of the first and second heat exchanger plates, and the transfer path being located in the second half of the one of the first and second heat exchanger plates;

the bypass path arranged to feed fluid from the open adiabatic distribution area directly to the heat transfer surface within the first half of the heat transfer plate; and the transfer path arranged to feed fluid from the open adiabatic distribution area directly to the heat transfer surface within the second half of the heat transfer plate; and the first heat exchanger plate being stacked with the second heat exchanger plate so that the bypass path of the first heat exchanger plate extends along the transfer path of the second heat exchanger plate, and the transfer path of the first heat exchanger plate extends along the bypass path of the second heat exchanger plate; and the greater width of the bypass paths relative to the transfer paths creating a bypass passage between the bypass path of the first heat exchanger plate and the transfer path of the second heat exchanger plate so that fluid enters a heat transfer passage between the heat transfer surface of the first heat exchanger plate and the heat transfer surface of the second heat exchanger plate from the bypass passage with a pressure drop that is lower than if the bypass and transfer paths of the first and second heat exchanger plates possessed equal widths.

8. A heat exchanger plate possessing a transverse extent, a lengthwise extent, a horizontal axis along the transverse extent of the heat exchanger plate that divides the plate into an upper half and a lower half, and a longitudinal axis along the lengthwise extent of the heat exchanger plate that divides the heat exchanger plate into a first half and a second half, the heat exchanger plate comprising:

a heat transfer surface having a corrugated pattern with a plurality of ridges and valleys;

first and third port holes positioned on the upper half of the heat exchanger plate, and second and fourth port holes positioned on the lower half of the heat exchanger plate;

first and second open adiabatic distribution areas positioned between the heat transfer surface and a respective one of the first and second port holes;

first and second closed adiabatic areas positioned between the heat transfer surface and a respective one of the third and fourth port holes;

each of the first and second open adiabatic distribution areas comprising a respective diagonal open side distribution support section positioned between a respective diagonal open groove and the heat transfer surface, and a respective diagonal open side adiabatic support section positioned between the respective open diagonal groove and the respective one of the first and second port holes;

each of the first and second closed adiabatic areas comprising a respective diagonal closed side distribution support section positioned between a respective diagonal closed groove and the heat transfer surface, and a respective diagonal closed side adiabatic support section positioned between the respective closed diagonal groove and the respective one of the third and fourth port holes;

first and second transfer paths, each positioned between a respective diagonal open side distribution support section and the heat transfer surface;

first and second bypass paths, each positioned between a respective diagonal closed side distribution support section and the heat transfer surface;

the first and second transfer paths and the first and second bypass paths delimiting the heat transfer surface;

wherein the first and second bypass paths are wider than the first and second transfer paths;

the transfer path and the bypass path arranged on the upper half of the heat exchanger plate extending on opposite sides of the longitudinal axis, and the transfer path and the bypass path arranged on the lower half of the heat exchanger plate extending on opposite sides of the longitudinal axis.

* * * * *